US006135388A

United States Patent [19]

Hostetter

[11] Patent Number: 6,135,388

[45] Date of Patent: Oct. 24, 2000

[54] SELF-ERECTING COLLAPSIBLE KITE

[76] Inventor: Todd Hostetter, 8041-26th Ave. NW., Seattle, Wash. 98117

[21] Appl. No.: 09/309,657

[22] Filed: May 11, 1999

Related U.S. Application Data

[60] Provisional application No. 60/116,022, Jan. 15, 1999.

[51] Int. Cl.[7] ..... B64C 31/06

[52] U.S. Cl. ..... 244/153 R; 244/153 A; 446/34

[58] Field of Search ..... 244/153 R, 153 A; 446/34

[56] References Cited

U.S. PATENT DOCUMENTS

| | | | |
|---|---|---|---|
| 671,865 | 4/1901 | Mowrer | 244/153 R |
| 770,626 | 9/1904 | Bell | 244/153 R |
| 3,193,224 | 7/1965 | Williamson | 244/153 R |
| 4,848,704 | 7/1989 | Sams | 244/153 A |
| 5,234,182 | 8/1993 | Renecle | 244/153 R |
| 5,343,887 | 9/1994 | Danaher | 135/104 |
| 5,529,266 | 6/1996 | Knight et al. | 244/153 R |
| 5,564,454 | 10/1996 | Curley et al. | 135/126 |
| 5,810,294 | 9/1998 | Knight et al. | 244/153 A |
| 5,833,174 | 11/1998 | Knight et al. | 244/153 A |
| 5,901,926 | 5/1999 | Zheng | 244/153 R |
| 6,045,093 | 4/2000 | Zheng | 244/153 R |

*Primary Examiner*—J. Woodrow Eldred
*Attorney, Agent, or Firm*—Joe Chalverus

[57] ABSTRACT

A kite that is self-erecting to a flying configuration having a forward opening with control line attached to a spool, a rearward opening with kite fabric stretched to form a surface between the openings, the forward opening urged from the rearward opening by flexible member support spars, the spars sized longer than the distance between the openings and aligned under tension between the openings to the extent permitted by the stretched fabric. The kite is collapsed into a generally flat storage configuration, by rotating one opening with respect to the other opening past a point of no return, the flexible member tension spars configuring themselves to a more relaxed, unaligned orientation. The two openings may be thus placed together into a storage configuration without disassembly and conveniently confined within side walls of the line spool, where one of the walls may be approximately the size of an opening to protect the kite. The kite is converted back to the flying configuration by twisting one opening with respect to the other in the opposite direction past the point of no return, the twisting redirecting and aligning the flexible member tension spars returning the kite into the flying configuration, the openings separating from each other by the coordinated and aligned urging of the support spars under tension.

19 Claims, 13 Drawing Sheets

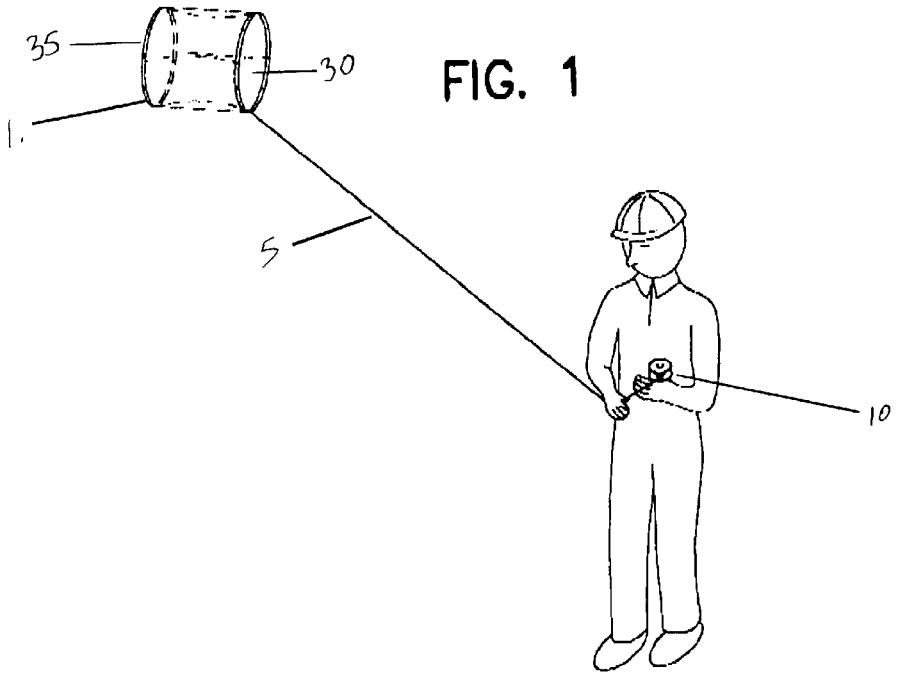
FIG. 1
FIG. 3
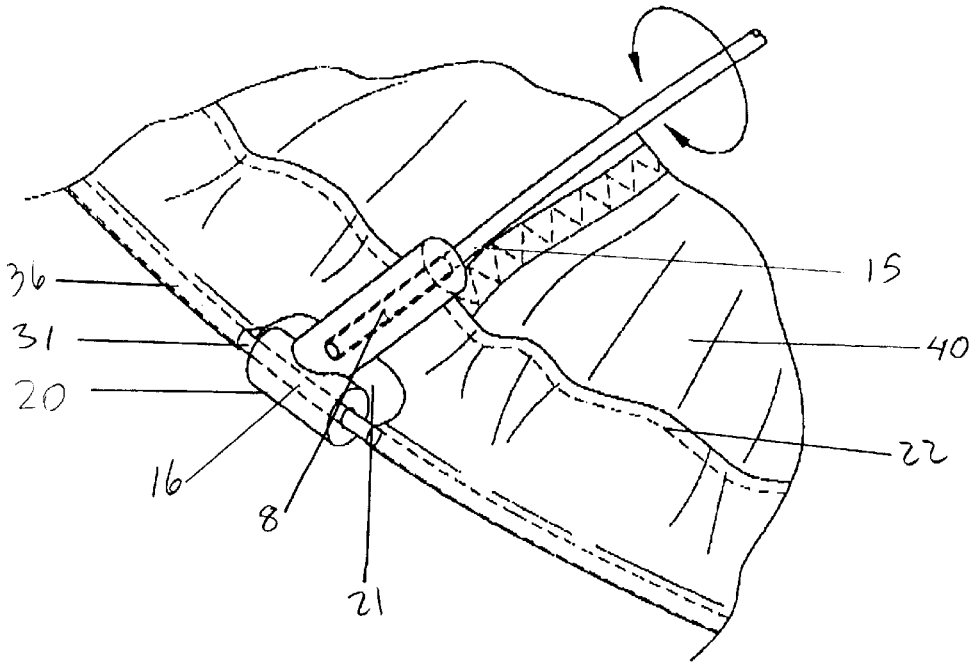

10
6
7
30
31
5
20
20
15
15
1
20
20
15
20
15
32
20
35
37

SELF-ERECTING COLLAPSIBLE KITE

PRIOR PROVISIONAL PATENTS

The inventor claims benefit of the provisional co-pending patent application entitled Collapsible Cylindrical Kite, filed on Jan. 15, 1999 with the U.S. Patent Office, No. 60/116,022.

BACKGROUND OF THE INVENTION

The present invention relates generally to aeronautical objects and toys such as airfoils and kites, more specifically to kites that are self-erecting, expanding into a flying configuration when desired collapsible, telescoping and folding for transporting and storage when not in use.

My invention is described in my provisional patent application entitled Collapsible Cylindrical Kite, filed on Jan. 15, 1999 with the U.S. Patent Office, No. 60/116,022. This is a continuation in part of that provisional application for the purposes of further describing several species of my invention.

Various aeronautic objects, devices and aircraft are known in the prior art to feature generally flat and curved surfaces, such as free flyers, gliders and airplanes or line controlled crafts such as kites. These aeronautic devices take advantage of differential pressures caused by air flow patterns around curved and flat surfaces to create a force called lift, balanced by a component called drag.

Kites are generally line held craft that are oriented into an airflow by their designs and by one or more control lines strategically attached to the kite. When the kite is exposed to the air flow such as wind and given the right conditions the kite will leave the ground tethered to the control line or lines.

A kite must be strong and light to be able to respond to the forces created by the wind but have extended surfaces to provide needed lift to leave the ground. These factors place a limitation upon the design of a kite since a kite with outstretched flying surfaces sufficient to provide the needed lift is not easily transported or stored. Therefore, before a kite is ready to fly it is assembled, that is support means are joined together with extended flying surfaces and locked into place then one or more control lines and perhaps a tail (depending on the kite design and stability) are attached to the kite before use. After use, the kites is disassembled, the extended flying surfaces and support means are unlocked and packed to facilitate transport and storage.

Some kite designs avoid the need to assemble for use and disassemble to facilitate transport and storage, such as:

U.S. Pat. No. 5,833,174, issued to Knight et al., which discloses a billowing rotary kite with a symmetrical wind receiving surface supported by a collapsible frame having a leading edge of radially oriented support vanes affixed to a hub locked to an axial rod in the center of the kite and to an annular member along the opening. The Knight kite is collapsed by unlocking the hub from the axial rod and sliding it with the support vanes along the axial rod to compact the kite for storage and transportation.

U.S. Pat. No. 3,193,224, issued to R. L. Williamson, which discloses a box kite construction comprising telescoping components of two sets of radially oriented support members fixed to umbrella-type hinge connection collars fixed to a center pole. The connection collars are locked to the center pole in an open configuration to fly the kite, then unlocked from the center pole to allow the kite to collapse for storage and transportation.

While these and other kites have the advantage of collapsing from an flying configuration into a more compact configuration for storage and transportation they are very different from a truly self-erecting collapsible kite.

BRIEF SUMMARY OF THE INVENTION

The present invention is embodied in a kite having two openings, a forward one and a rearward one separated by a flying surface in a flying configuration, held in this flying configuration by flexible member support spars under tension. After flying, the kite is reduced into a generally flat storage configuration, by rotating one opening with respect to the other opening, the flexible member tension spars configuring themselves to a more relaxed configuration. The two openings can be placed together without disassembly and confined within the side walls of the line spool, as described herein. The kite is converted back to the flying configuration by twisting one opening with respect to the other in the opposite direction, the twisting redirecting the flexible member tension spars to return under tension and expand the kites by separating the openings from each other and return the flying surface to a taunt state by tension.

The flexible member tension spars are made of lightweight fiberglass rods capable of bending into tight circular configurations without breaking but retaining memory, that is a desire to return to its linear orientation. The flexible member tension spars are sized longer than the distance between the openings of the kite. By spanning from one opening to the other they become distorted from a straight orientation. The distortion of the tension spars maintains tension along the flying surface of the kite. When the openings are twisted with respect to each other, the flexible tension spar members reorient themselves, and the kite may collapse so that the openings can be placed adjacent to each other.

While configuration of the openings determines the flying shape of the kite, all fall within the invention. With circular openings, the flying shape of the kite assumes a cylindrical configuration. A kite with four corners on each opening assumes a cube or cuboid shape, depending on the size and shape of the opening with relation to the distance between the forward and rearward openings The three corner opening produces a triangular prism, five corner opening will pentagonal prisms, hexagonal or six corner openings produce a hexagonal prism, etc.

In the storage configuration, a line storage reel having a line spool and side walls properly sized are used to interact with the flexible tension spar members to constrain the kite and its flexible tension spar members into a compact, portable unit. With side walls of equal sizes, the line storage reel placed within the center of the flattened openings confines the kite into a compact, easily transportable unit.

With one of the side walls of the line storage reel the same size as the opening of the kite, that enlarged side wall also serves as packaging and protective elements of the kite material in the storage configuration.

Accordingly, it is a general object of the present invention to provide an improved collapsible kite that is truly self-erecting and does not need to be assembled nor disassembled to use or to place in storage.

More specifically, it is an object of the present invention to provide a kite that is strong, lightweight and stable in the flying configuration yet adaptable to be quickly configured into a compact, flat configuration when not in use without locking or unlocking elements.

It is also an object to provide a kite with the above described advantages that further uses a line storage reel in the usual manner when flying the kite, but advantageous to the storage of the kite is not in use.

It is another object of the present invention to attain the foregoing objects and also to provide a self-erecting collapsible kite with a line storage reel having side-walls that can serve to confine the kite and its elements into a compact easily transportable unit.

Another important object of my invention is to provide a self-erecting collapsible kite with a line storage reel having one enlarged side wall that will protect the kite in the storage configuration.

Further objects and advantages of my invention will become apparent from a consideration of the drawings and ensuing description thereof.

BRIEF DESCRIPTION OF THE DRAWING

FIG. 1 is a perspective view of my self-erecting collapsible kite with circular openings in the flying configuration.

FIG. 3 is a fragmentary exploded close-up view of the spar attachment to a tee element on an opening support member.

DESCRIPTION OF THE PREFERRED EMBODIMENTS

The present invention is embodied in a generally a billowed kite 1 shown in FIG. 1 in the flying configuration, here a cylindrical shaped kite. As will be seen below, the final geometric display of the kite will be determined by the selection of the shape of two openings.

The kite 1 is held by the enthusiast with a kite control line 5 tied to a line storage spool 10. The line 5 can be any flexible, strong cord capable of withstanding the forces exerted by the kite in the wind. The line is wound up onto a spool 10 having sidewalls 6 and 7.

Figure 2:
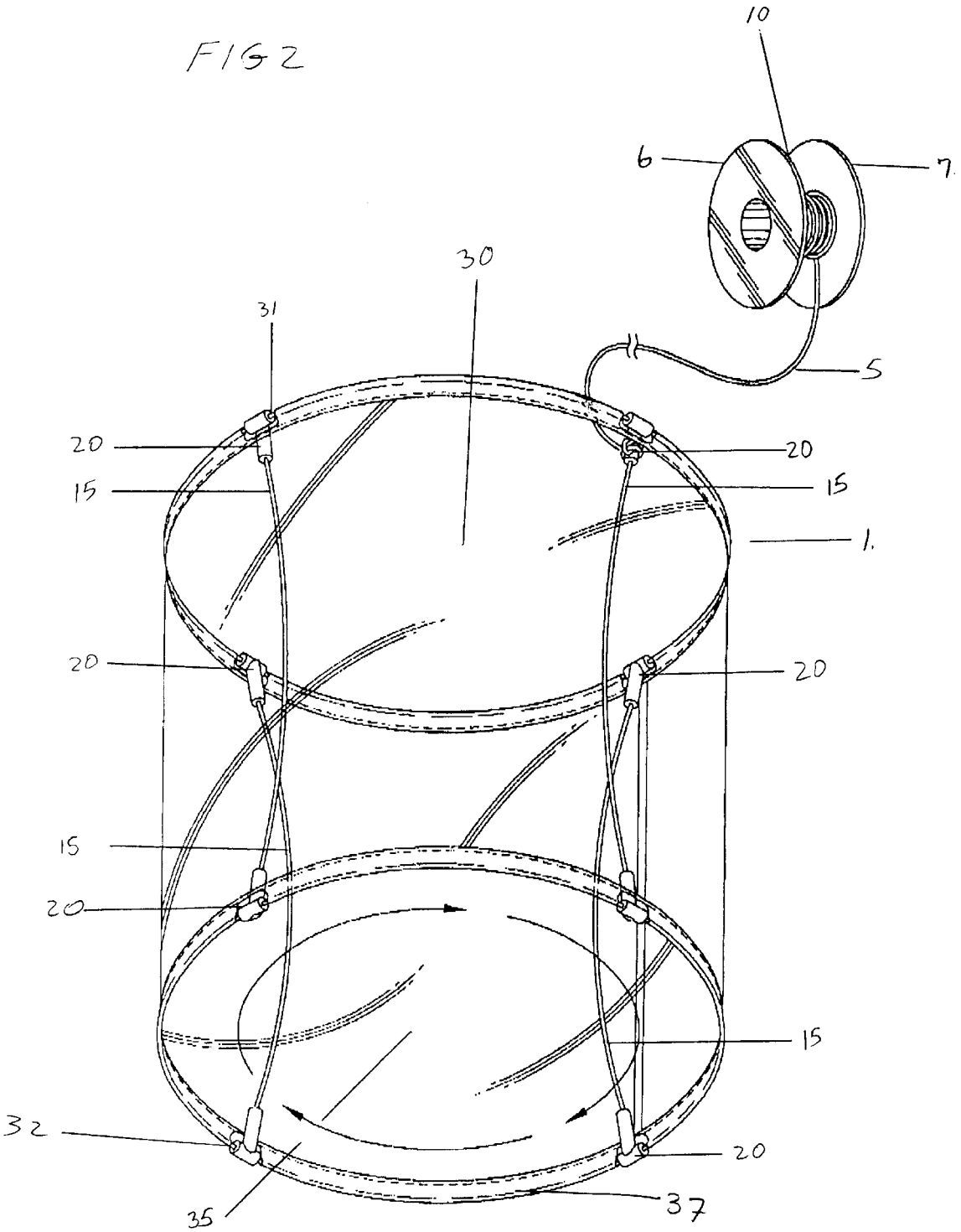
FIG. 2 is a side elevational view showing the elements of my invention in the flying configuration tied to a line storage reel.

The end of line 5 is tied at a tee joiner 20 at one of the tension spar members 15 as seen in FIG. 2. The tee joiner 20 assists the construction of the kite. Each support spar 15 attaches to the kite through the tee 20 at a opening support 31 best viewed in FIG. 3. The spar 15 is inserted into the center length void 8 to orient and constrain the spar to the tee 20. Importantly, the spar thus constrained is permitted to rotate within the center length void 8 as will become clear later in this description.

Whatever the configuration, my kite 1 has two large openings, shown here as one forward circular opening 30 and a rearward circular opening 35. In this embodiment, both openings are identical and constructed by supports shaped into a closed figure as will be discussed later. The control line is tied to one end to define the forward opening 30, which is oriented towards the direction of the wind. The other opening, the rearward opening 35 will be the opening oriented away from the wind, as shown in FIG. 1.

For the cylindrical embodiment both circular openings 30 and 35 are maintained in a circular configuration by opening support members 31 and 32. These support members 31 and 32 can of course, be shaped to any other closed configuration to provide other interesting shapes other than a circle. As will be described later.

Circular support members 31 and 32 could also be made by materials containing a memory, such as with light-weight fiberglass rods cut into sections that are capable of bending into tight circular configurations without breaking. Using this material, a fiberglass rod with a circular cross section would have a memory urging the rod to return to a linear orientation. This would produce a circular opening 30 and 35 urging to be a circle while constrained within the forward edge channel 36 and rearward edge channel 37 and joined at a tee 20.

Enhanced view FIG. 3 shows how the support member 31 fits through a passage void 16 through the tee 20 and along a channel 36 sewn within the kite flying material 40. Support member 32 fits through a passage void 16 through another tee 20 and along a channel 37 sewn within the kite flying material 40 on the opposite end of the kite in the same manner.

The circular kite configuration shown in FIGS. 1–7 teach four tees 20, equally spaced along each support member 31 and 32. Each support member 31 and 32 is placed into the void 16 of a tee 20. Channel 36 and 37 are made by sewing the ends of the covering along the far ends of the kite covering 40. A gap 21 within the material 40 accommodates the tee 20.

The kite covering 40 is cut from flexible water resistant semi-impermeable material to form the kite surface. A suitable kite surface material is sometimes called "spinnaker" cloth, a very strong but light-weight fabric made from rip-stop "NYLON" or similar material coated to be rain impermeable to maintain its warp and weft with minimum stretching or distortion yet adaptable to be cut and sewn without disturbing its strength and qualities.

To configure the covering 40, a suitable piece of material is cut, then two opposite sides are seamed by stitching 22 around the entire end to create the channel 36 on the forward opening and channel 37 on the rearward opening. Gaps 21 are cut from the material at both ends of the cylinder, equally spaced around the opening to accommodate tees 20. These gaps 21 are cut congruent to each other from the material at the open ends so that the gaps on the forward opening 30 coincide and are aligned with the gaps on the rearward opening 35. Support members 31 passes along channel 36, then through the voids 16 of the tees 20 placed at the gaps 21. The two ends of the support members are joined (not shown) within the void 16 of one of the tee 20 at that gap 21.

The kite material 40 is cut and sewn so that with the opening supports in place, the forward and rearward openings 30 and 35 are spaced, parallel and the tee joiners 20 are congruent to each other at opposite sides of the kite.

For each tee 20, a spar 15 is inserted into the center length void 8 the tee 20 on one opening to span to the center length void 8 of the corresponding tee 20 on the other opening. The spars 15 are thus aligned in a parallel or congruent fashion between the openings 30 and 35.

Each spar 15 is made from solid "pultrudded" linear carbon rod and cut to a length longer than the distance between the openings, as described above. For this embodiment, I use pultrudded linear carbon rod having a circular cross section of 0.070 inches in diameter, cut to size. This carbon rod has the property of being very strong and flexible able to maintain a strong memory or tension in the extruded linear configuration. That is, the spars made of this material desire to return to a linear orientation when bent. Because the length of the spar is sized to be longer than the distance between the congruent tees 20, the spars 15 must bend or bow and will maintain a tension since the distance between the openings are constrained by the kite covering 40.

In this embodiment, a typical distance between the forward and rearward opening 30 and 35 is 12 inches and the spars 15 are sized to 12.5 inches in length, so that each spar provides an urging component. Consequently, the aligned spars 15 bending under tension as they span between the congruent tees 20 cooperatively urge the support opening 30 to separate from the opening 35 to the limit imposed by the kite covering 40. The spars 15 open the kite into the flying configuration as featured in FIG. 1 and FIG. 2. Because of the symmetrical positioning of the spars attached to congruent tees 20 between the openings 30 and 35, the spars 15 tend to bow towards the center line of the kite. While this position is the preferred, it is also possible that the spars are placed within the tees 20 so that the spars 15 tend to bow away from the center line of the kite, to give the kite a different appearance. The height of the arc of the resulting bow of the spar using corresponds to the relative size of the spars with respect to the distance between the openings. It should be appreciated that longer spars provide more divergent arcs and stronger urging components constrained within the congruent tees 20 of the openings 30 and 35 than shorter spars, limited by the flexibilty of the spars.

This flying configuration is very stable. The kite will resist and recover from most deformations caused by wind gusts and normal handling. Small rotations or perturbations of the forward opening 30 with respect to the rearward opening 35 will not disturb the stable configuration of the kite 1 in the flying configuration and the kite will quickly return to its flying configuration from normally small perturbations of these kind. This is because, small rotations of the opening 30 with respect to opening 35 will create forces or resistance to rotation. The kite flies by the resulting lift caused by air flowing across the taunt kite covering under tension by the urging of the spars 15 spanning the congruent tees 20 attached to the openings 30 and 35.

Figure 4:
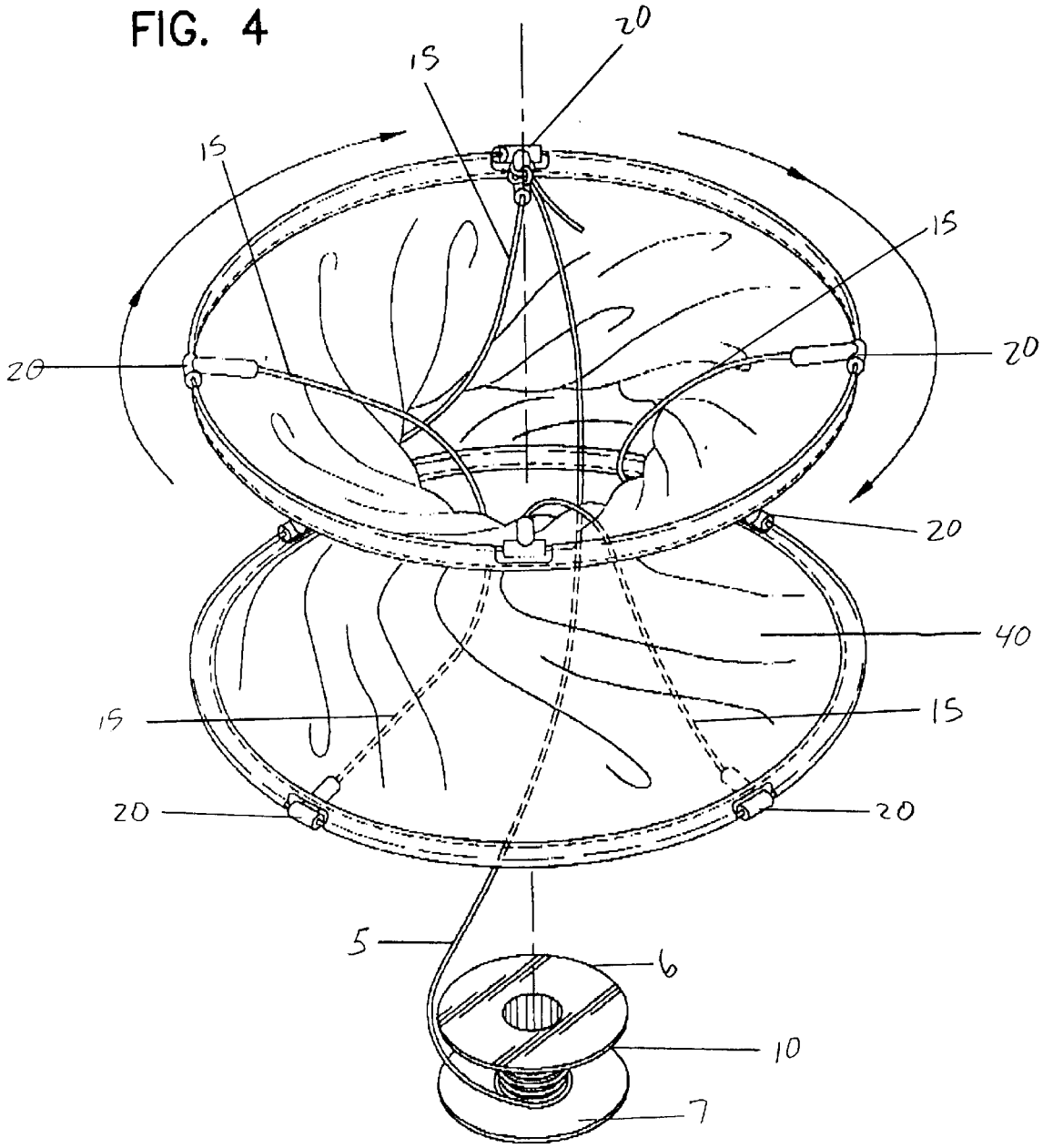
FIG. 4 is a top perspective view of my self-erecting collapsible kite, having circular openings, one opening rotating with respect to the other opening.

While the kite 1 is a stable configuration, by rotating the forward opening 30 with respect to the rearward opening 35 as shown by the arrows in FIG. 4 the spars 15 will bend and reconfigure themselves. The spars 15 will rotate within the center length void 8 of the tees 20 as shown by the arrow in FIG. 3.

The kite is converted into the storage configuration shown in FIGS. 5, 6,7 and 8 by large rotations of the forward opening 30 with respect to the rearward opening 35. A large rotation will reconfigure the spars 15 as shown in FIG. 4. This is done by grasping the forward opening 31 and twisting it with respect to the rearward opening 32 through a recover point, felt when the resistance to rotation suddenly disappears. When this happens, the spars 15 reconfigure and rotate within the center length void 8 of the tees 20 as shown by the arrow in FIG. 3. The new configuration of the spars 15 are no longer aligned and will no longer cooperatively urge the forward opening 30 to separate from the rearward opening 35. The kite collapses. The forward and rearward openings 30 and 35 telescope towards each other, the kite covering 40 folding as the spars 15 reconfigure within the tees 20. When the two openings 30 and 35 close towards each other they can be set side by side in a generally flat orientation as is shown by FIGS. 5–8.

Figure 5:
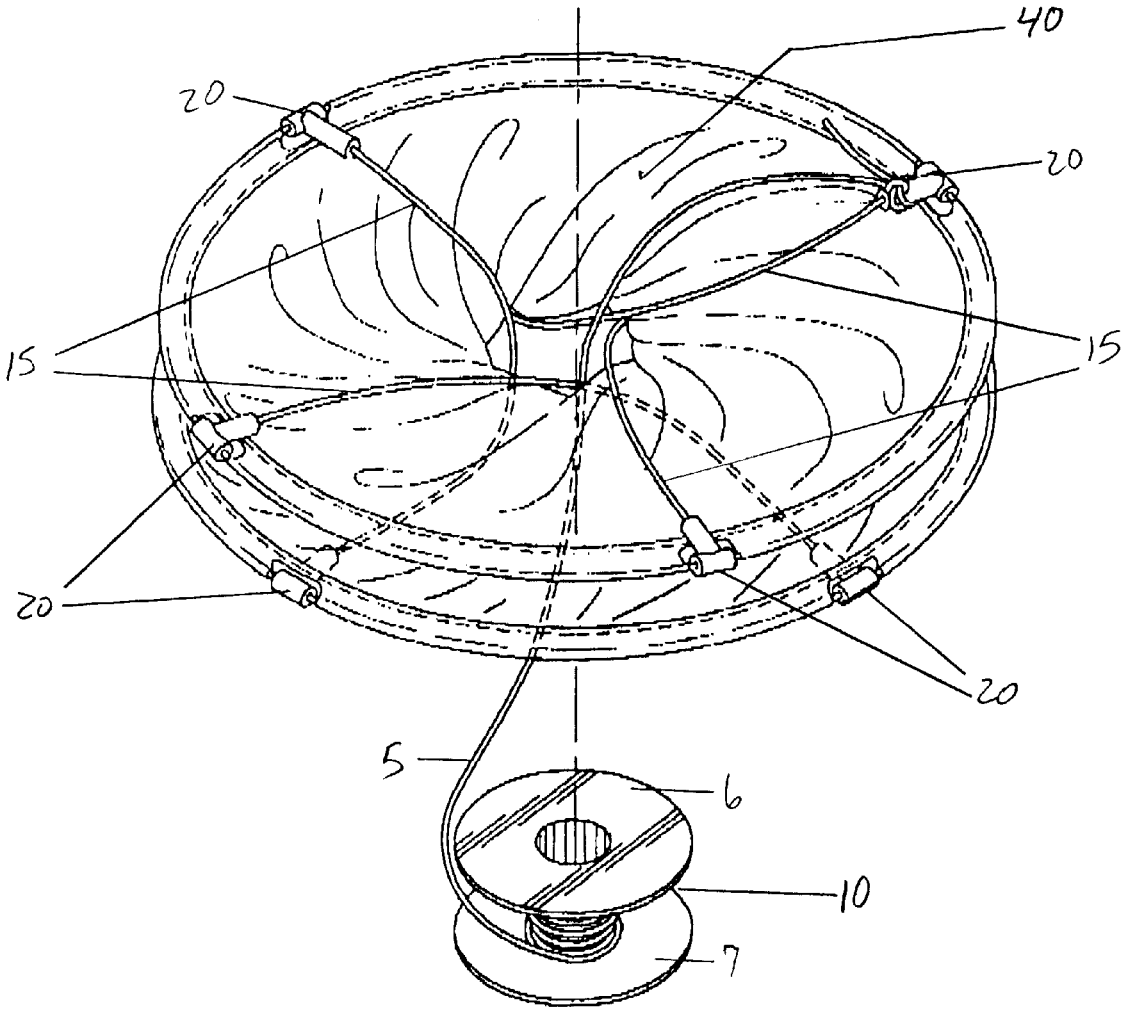
FIG. 5 is a top perspective view of my invention having circular openings in the storage configuration in relation to the line storage reel with sidewall, prior to the line storage reel interacting with the kite spar elements.
Figure 6:
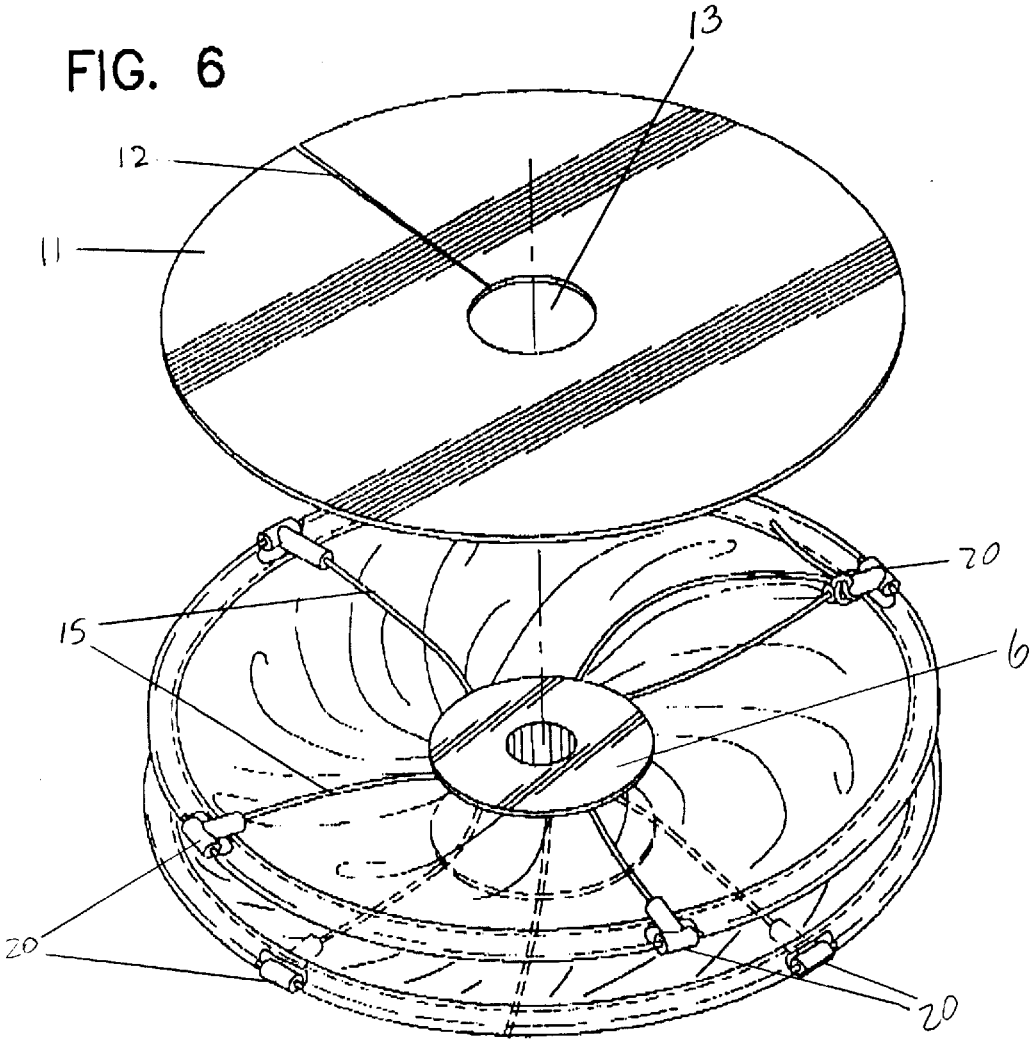
FIG. 6 is a top perspective view of my invention with circular openings in the storage configuration detailing the line storage reel sidewalls interacting with the kite spar elements and an enlarged line storage reel sidewall.

To contain the elements of my kite in the storage configuration, as seen in FIGS. 5 and 6, sidewalls 6 and 7 of the spool 10 are used to sandwich the spars 15 and the available kite covering 40 within the confines of the sidewalls 6 and 7 of the line spool 10.

Figure 7:
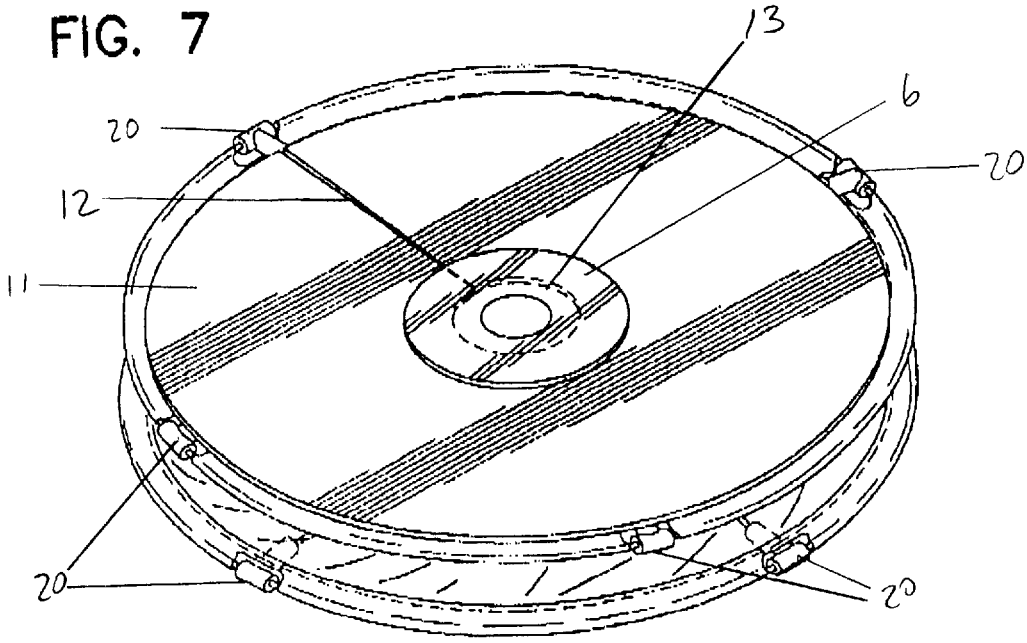
FIG. 7 is a top perspective view of my invention with circular openings in the storage configuration, as shown in FIG. 6 with the enlarged line storage reel sidewall in place.
Figure 8:
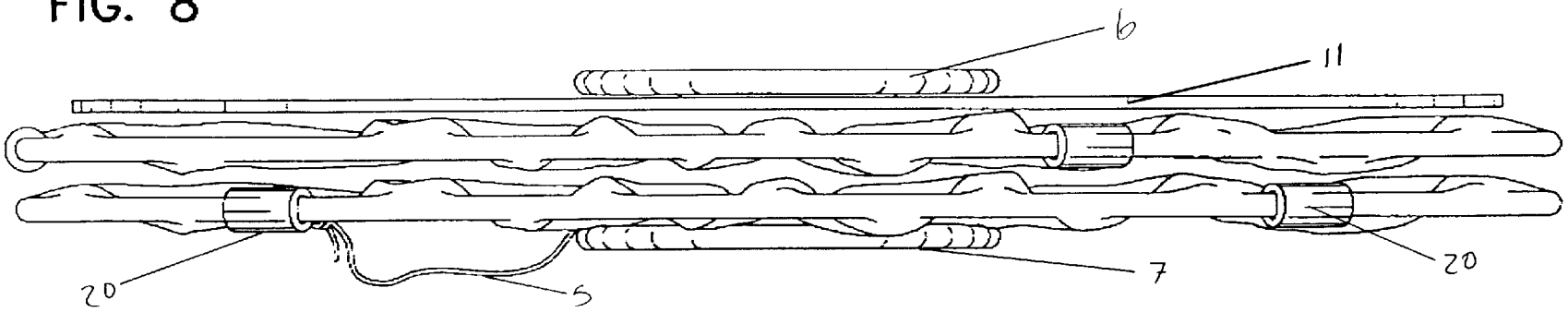
FIG. 8 is a side view of my invention in the storage configuration, as shown in FIG. 7.

To further protect the kite in the folded or storage configuration, as seen in FIGS. 6 and 7, a circular shaped side protector 11 with a radial oriented gap 12 and center spool bore 13 conforming to the line spool size and side walls 6 or 7 of the spool 10. The side protector 11 is sized to cover the opening of the kite in the folded or storage configuration and is held onto the openings 30 or 35 by side wall 6 of the spool 10. The side protector 11 can be made from any pliably material; a good material is cardboard. My invention provides that this side protector 11 may be part of the packaging and may have information regarding my kite printed on the outside of the protector 11. Of course, two enlarged side protectors, one on each side wall, would completely cover both sides of the kite.

The kite can be quickly converted to the flying configuration 1 from the storage configuration by grasping and rotating the forward opening support member 31 with respect to the rearward opening support member 32. At first a resistance to the rotation will be felt, then once the rotation exceed a recover point, resistance to rotation suddenly disappears and the kite becomes self-erecting, that is the kite will assume the stable configuration of being fully extended in the flying configuration of 1, urged into the open and stable configuration by the spars 15. Once again, the kite 1 is ready to fly, since the control line 5 is still attached to the spar 15 at the forward opening 30.

Figure 9:
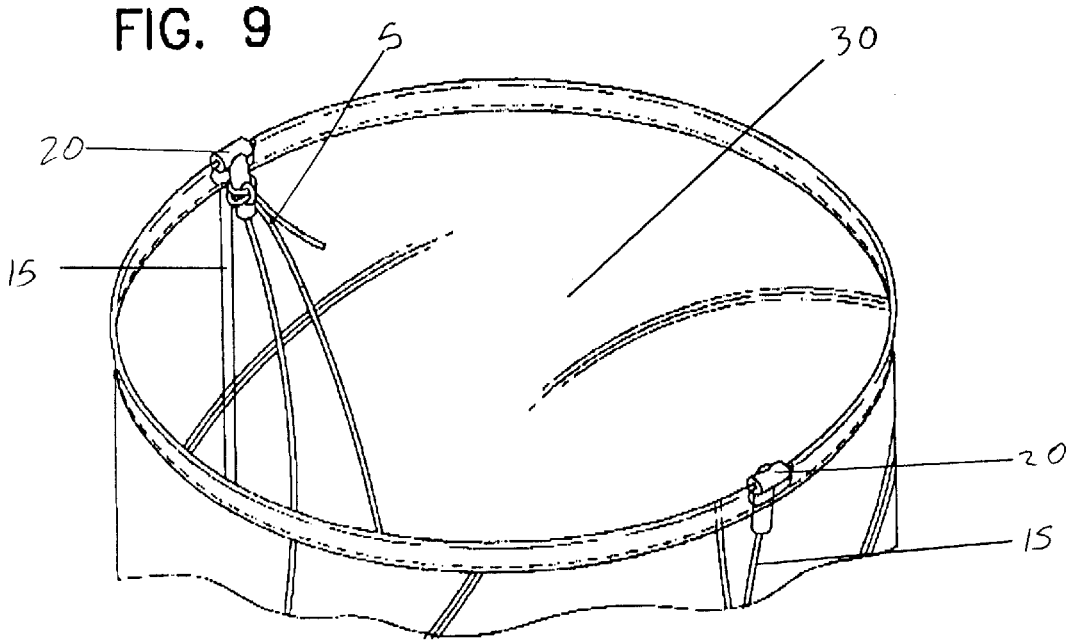
FIG. 9 is a side elevation fragmental view of my invention showing a variation of my invention using two tension spar members.
Figure 10:
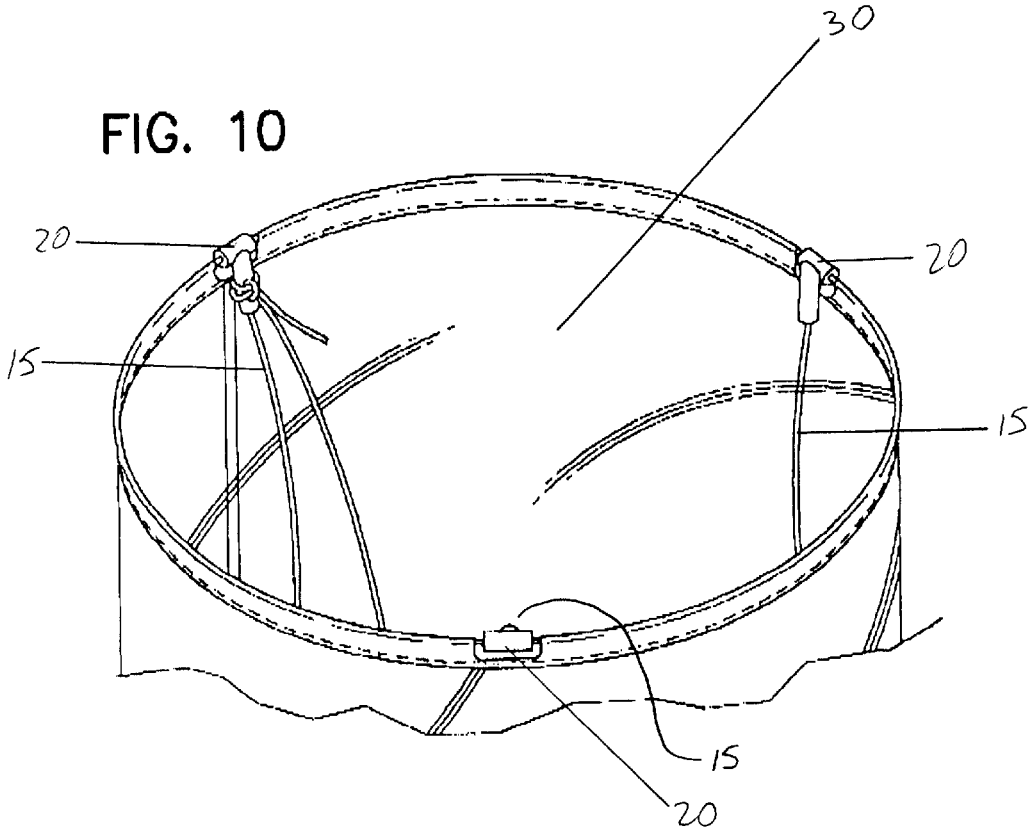
FIG. 10 is a side elevation fragmental view of my invention showing a variation of my invention using three tension spar members.

While FIGS. 1–8 describe my kite having 4 spars between the forward and rearward openings, alternative configurations of my kite having alternate numbers of spars 15 of any number greater than one should be also considered within the scope of my invention. FIG. 9 shows a section of my kite with only two spars 15, each spar 15 joined to the forward 30 and rearward opening (not shown) using a tee 20 as in the first embodiment of my invention. The two spars 15 are attached on the forward and rearward openings 30 and 35 in the same equally spaced, aligned parallel in a congruent fashion described in the four spar version. Likewise, FIG. 10 shows a section of my kite using three spars. The three spars 15 span between the forward opening 30 and rearward opening (not shown) in the same, aligned, equally spaced, congruent fashion described above for the four and two spared kites. Likewise, kites constructed within the spirit of my invention having more than four spars positioned with evenly spaced congruently placed tees to span between the openings in a similar fashion as described above should be considered within the scope of my invention.

My kite can be constructed with other configurations using this invention, as long as the openings are closed configuration, and the spars span between the openings under bending tension in a congruent manner, that is spars join the two openings with an urging force to maintain the openings apart.

Figure 12:
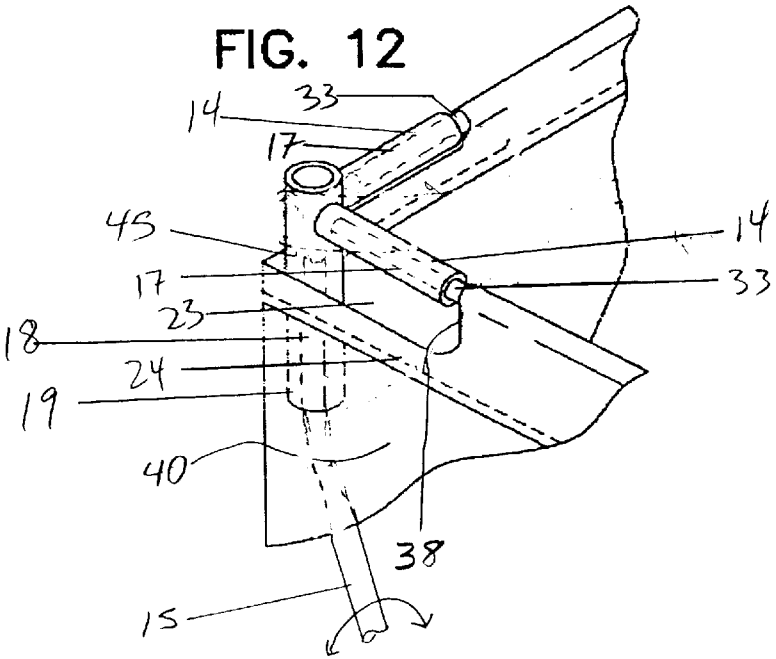
FIG. 12. is a fragmental view of a portion of the opening of my kite at a junction of several support members.
Figure 11:
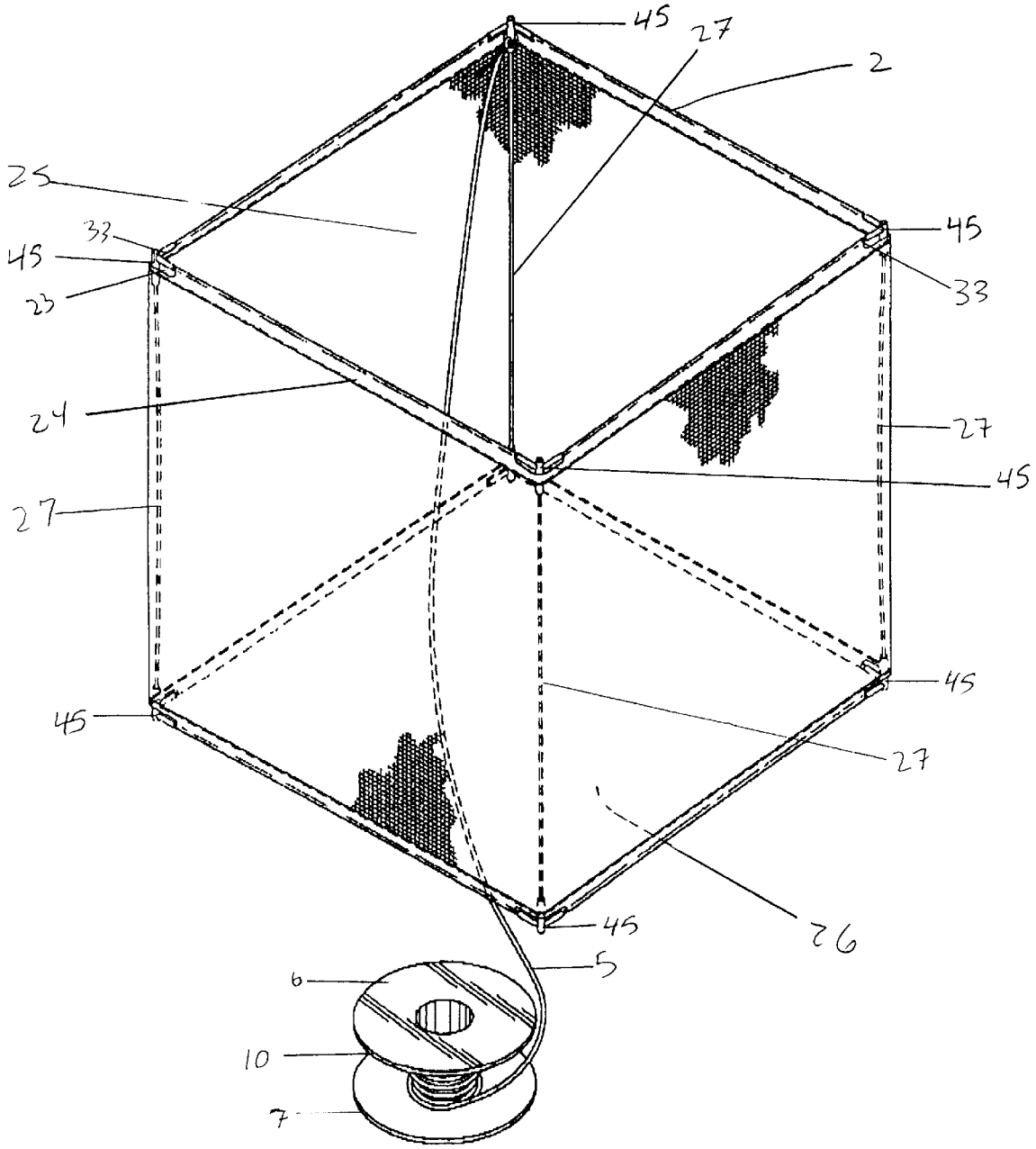
FIG. 11. is a top perspective view of my invention in the flying configuration with four corner openings.

To demonstrate that my invention provides for other constructions, consider the four corner kite 2, with a line spool 10 and control line 5, having forward opening 25 and rearward opening 26, shown generally as 2 in FIG. 11 have corner joiner 45 best seen in fragmented view FIG. 12. The corner joiner 45 assists the construction of a kite with corners, as in the cylindrical kite. The corner joiners 45 having lateral arms 14 assemble opening and closing support members 33, with through voids passages 17. If the forward 25 and rearward 26 openings are square or rectangular, then the corner joiner 45 will have its lateral arms 90 degrees from each other to retain the support members 33 at angles of 90 degrees to each other. For square openings, all the support members 33 will be of the same size, and with rectangular openings, the two opposite support members on each opening will be the same length, but different than the adjacent support members. Other angles are also possible and would produce different than right angle openings configurations, depending upon the angle between the lateral arms 14. but geometry requires that the sum of the angles between the lateral arms 14 for all the corner joiners 45 total 360 degrees for four corner kites. To assemble the four corner kite, as with the other configurations, the kite flying material 40 is cut to accommodate a gap 23 for the joiners 45 and sewn along the openings with stitches 24 along all the edges of each opening to accommodate support members 33 fixed inside the channels 38 formed by the stitching 24 in the kite flying material 40. To provide the tension across the kite material, spars 15 are set into the bottom arm 19 through passage void 18 on joinder 45 (see FIG. 12) to span under tension between congruent forward and rearward openings 25 and 26. As with all the kites within the scope of my invention, these spars 15 are cut oversize, that is longer than the distance between the openings so that the spars 15 must bow or bend in order to impart a separation force or tension between the forward 25 and rearward 26 openings. The spars bow or bend towards the center line of the kite, although they may also span outside the confines of the kite in which case they would bow or bend away from the center line of kite.

With the end of the control line 5 tied to the joiner 45, the kite in the expanded configuration is ready to fly. As in the other configurations the point where the end of the control line connects to the kite defines the forward opening as opposed to the rearward opening.

As is the cylindrical kite, this flying configuration is very stable and will resist and recover from most deformations caused by wind gusts and normal handling. Small rotations or perturbations of the forward opening 25 with respect to the rearward opening 26 will not disturb the stable configuration of the kite 2 in the flying configuration and the kite will quickly return to its flying configuration from normally small perturbations of these kind.

Figure 13:
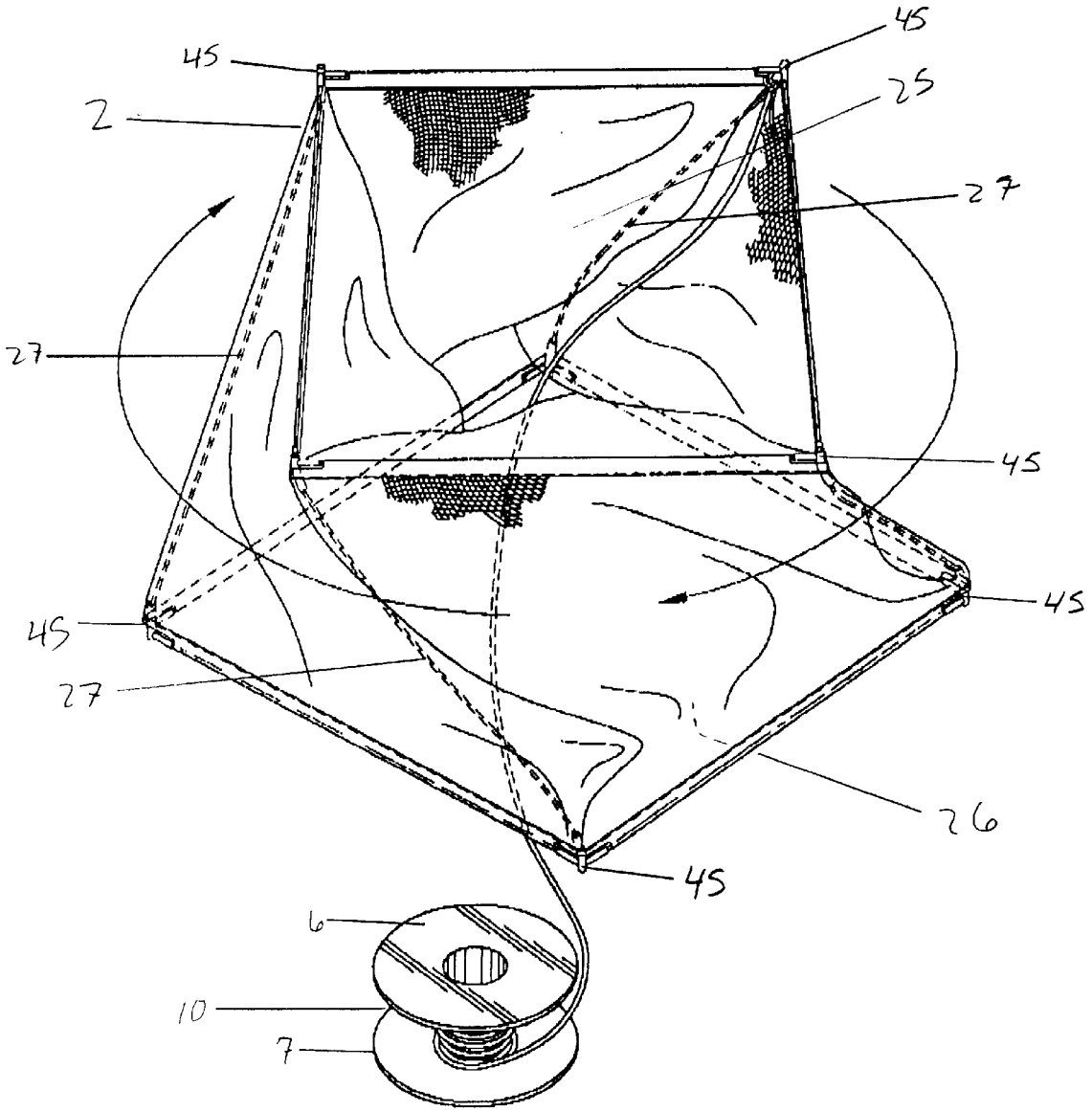
FIG. 13. is a top perspective view of my self-erecting collapsible kite having four corner openings, one opening rotating with respect to the other opening.
Figure 14:
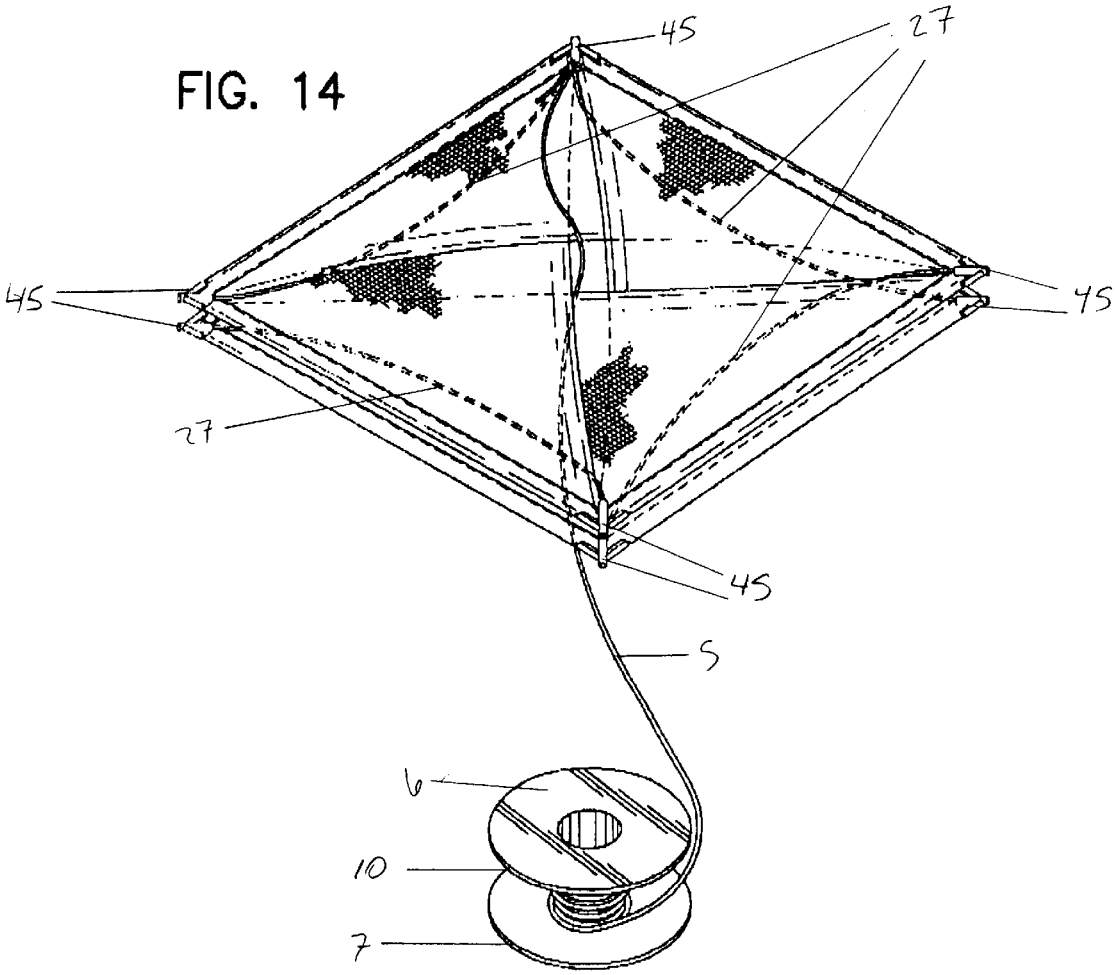
FIG. 14. is a top perspective view of my invention having four corner openings in the storage configuration prior to the line storage reel interacting with the kite spar elements.
Figure 15:
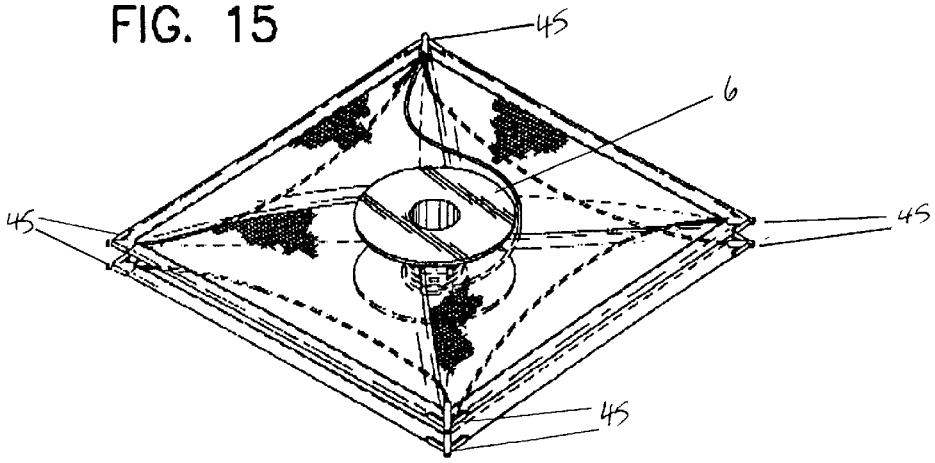
FIG. 15 is a top perspective view of my invention having four corner openings in the storage configuration detailing line storage reel sidewalls interacting with the kite spar elements.

This kite 2 is collapsed in the same way as the cylindrical kite 1, by rotating the forward opening 25 with respect to the rearward opening 26 as shown by the arrows in FIG. 13. The spars 15 bend and reconfigure themselves converting the kite into the storage configuration shown in FIGS. 14 and 15. This is done by grasping the forward opening 25 and twisting it with respect to the rearward opening 26 through a recover point, felt when the resistance to rotation suddenly disappears and the kite collapses. The forward and rearward openings 25 and 26 may telescope towards each other, the kite covering 40 folding as the spars 15 reconfigure and the openings set side by side in a generally flat orientation as is shown by FIGS. 14 and 15.

As in the cylindrical kite 1. The kite 2 is arranged into a storage configuration, as seen in FIG. 15, with sidewalls 6 and 7 of the spool 10 used to sandwich the spars 15 and the available kite covering 40 within the confines of the sidewalls 6 and 7 of the line spool 10.

The kite 2 can be quickly converted to the flying configuration 2 from the storage configuration in the same manner as the cylindrical kite 1 by grasping and rotating the forward opening support member 25 with respect to the rearward opening support member 26 past a recover point when resistance to rotation suddenly disappears and the kite becomes self-erecting. At this point the kite returned to the stable configuration of being fully extended in the flying configuration of 2, urged into the open and stable configuration by the spars 15.

Figure 16:
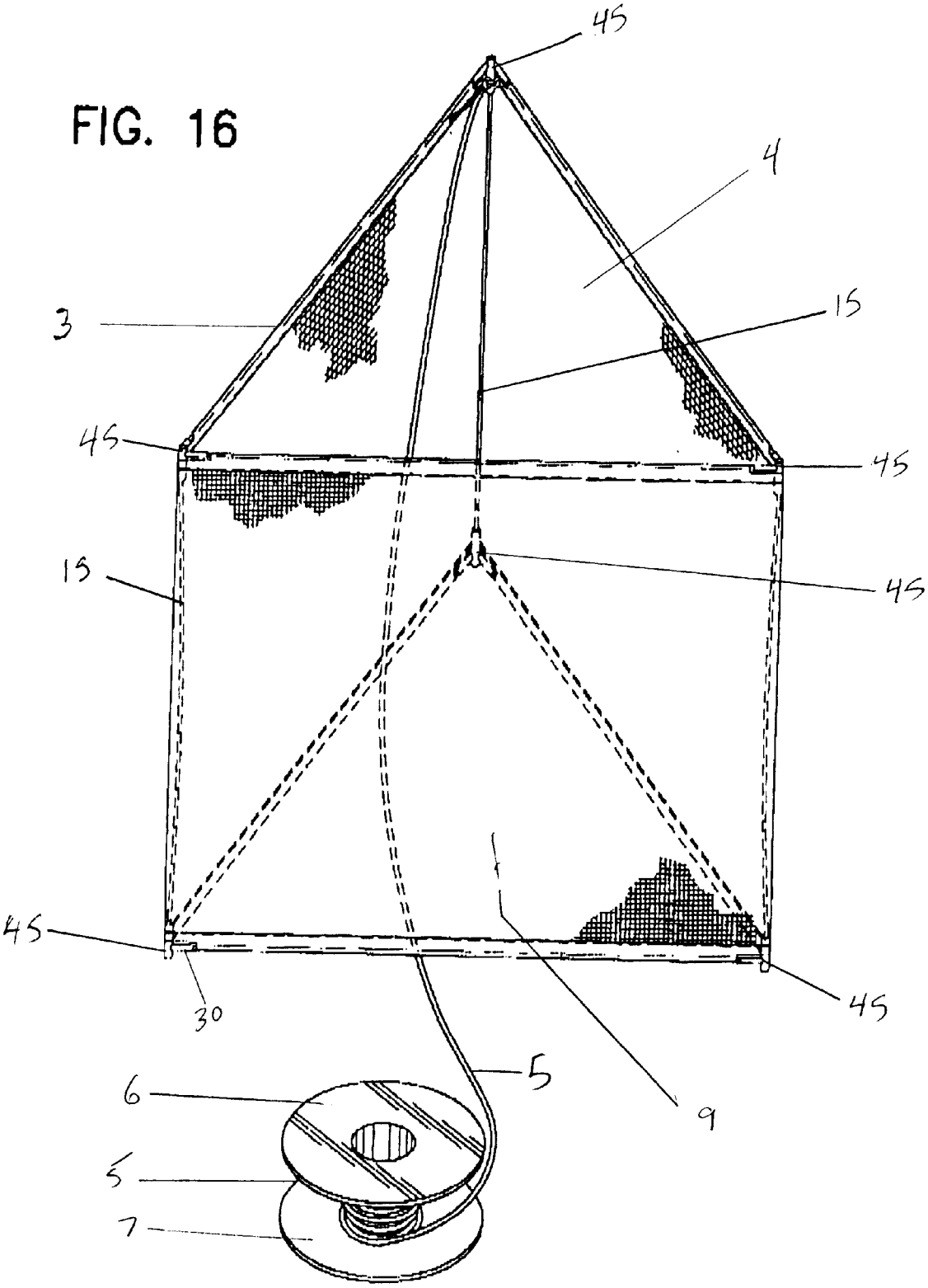
FIG. 16. is a top perspective view of my invention in the flying configuration with three corner openings.

The three sided or triangular prism kite 3 shown on FIG. 16 is constructed following the same principles as the four corner and cylindrical kites. Corner joiners 45 attach support members 33 through passage voids 17 on the lateral arms 14 in the corner joiner 45 to form triangular forward opening 4 and rearward opening 9. For the triangular prism kite, three support members 33 form a forward opening 4 and another three support members 33 form the rearward opening 9. The support members 33 may be of the same length, or different lengths as long as the members on the forward opening 4 are congruent to the members on the rearward opening 9. The constrain angles between the lateral arms 14 on the joiners 45 may acute, obtuse angles or right angles, except geometry requires that the sum of the constrain angles total 180 degrees.

Spars 15 are set into the bottom arm 19 through passage void 18 on joinder 45 (see FIG. 12) and span under tension between the congruent forward and rearward openings 25 and 26. These spars 15 are cut oversize so that when placed between the openings, the spars 15 bow or bend. The bending of the spars impart a separation force or tension between the forward 25 and rearward 26 openings. The spars 15 bow or bending towards the center line of the kite, when placed inside the kite although they may also span outside the confines of the kite in which case they would bow or bend away from the center line of kite.

With the end of the control line 5 tied to the joiner 45, the kite in the expanded configuration is ready to fly. As in the other configurations the opening to where the end of the control line connects, defines the forward opening as opposed to the rearward opening.

Figure 17:
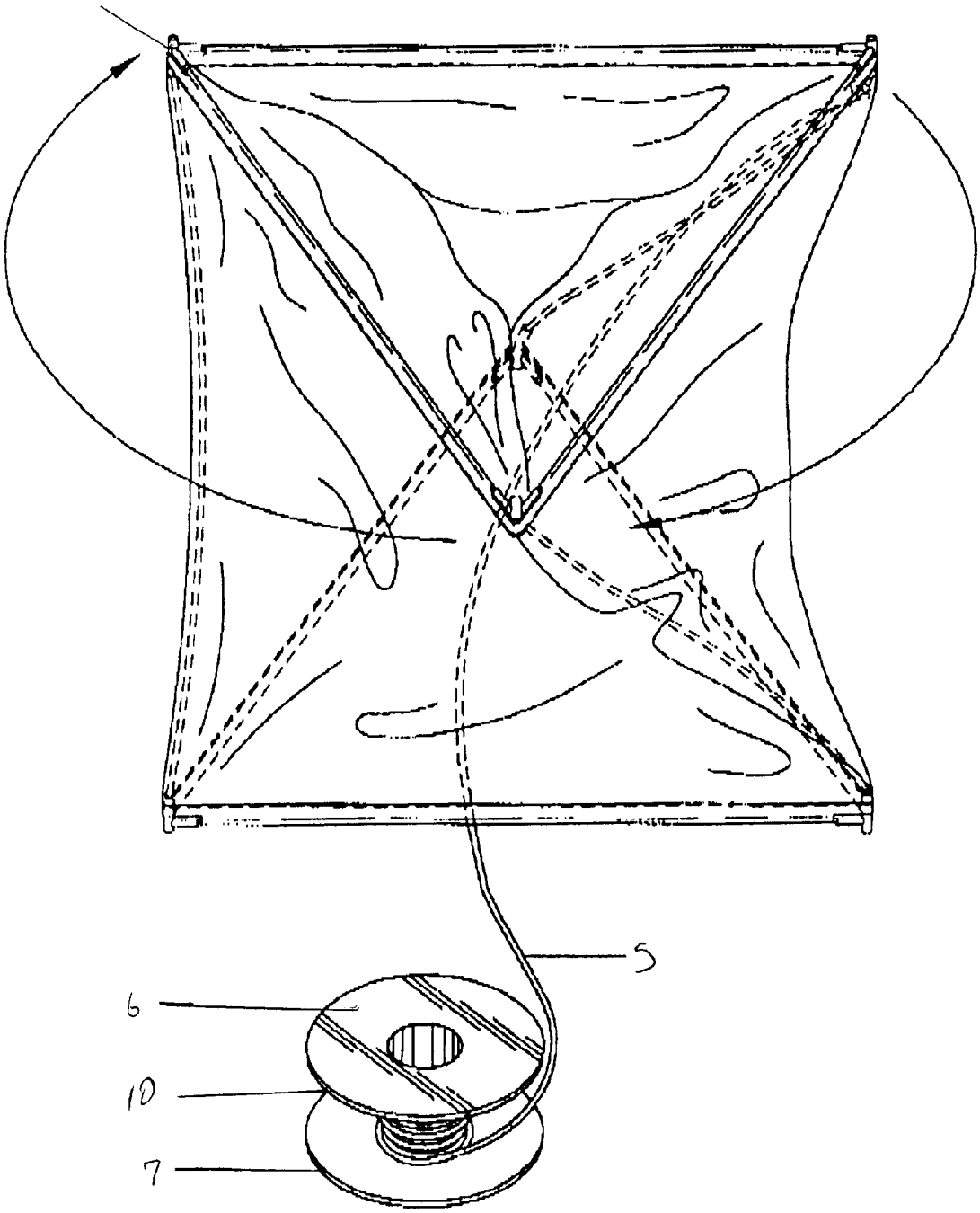
FIG. 17. is a top perspective view of my self-erecting collapsible kite having three corner openings, one opening rotating with respect to the other opening.
Figure 18:
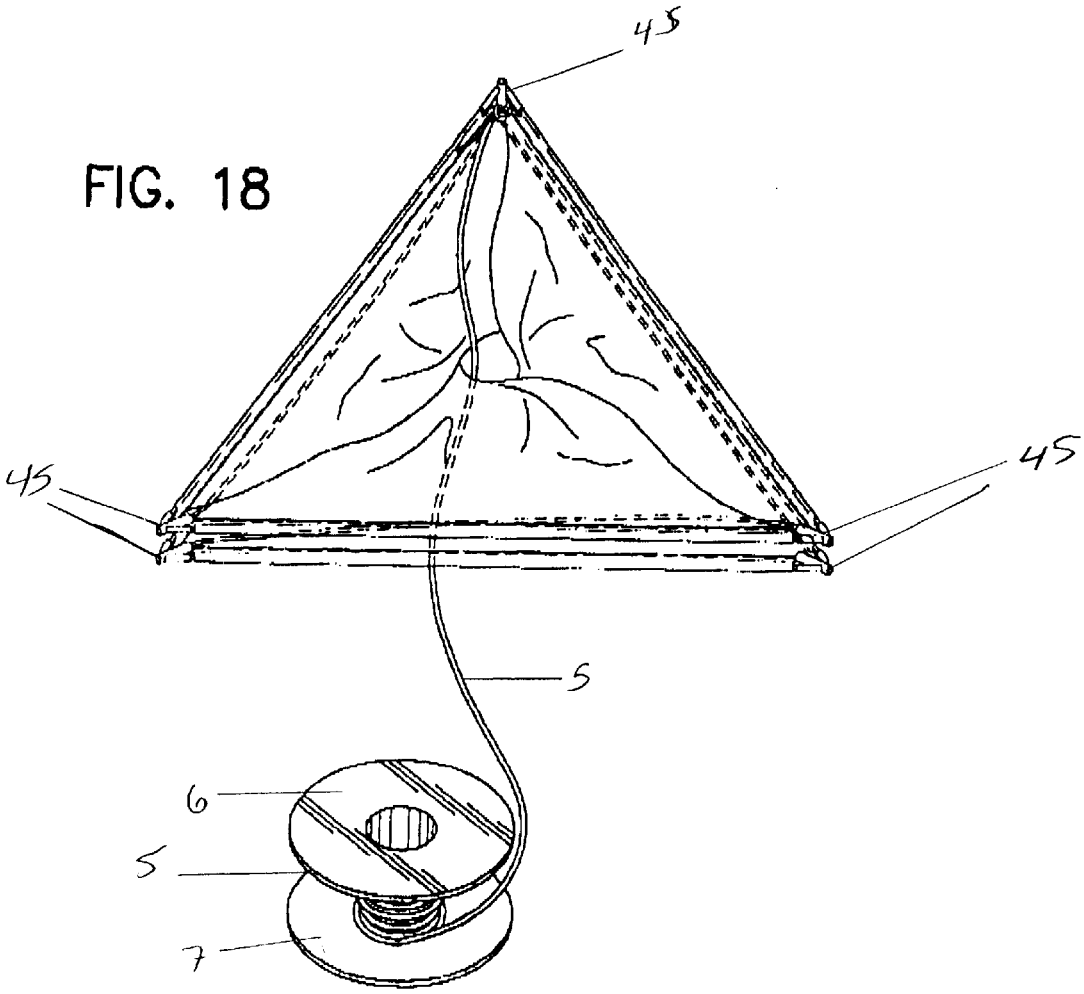
FIG. 18 is a top perspective view of my invention having three corner openings in the storage configuration prior to the line storage reel interacting with the kite spar elements.
Figure 19:
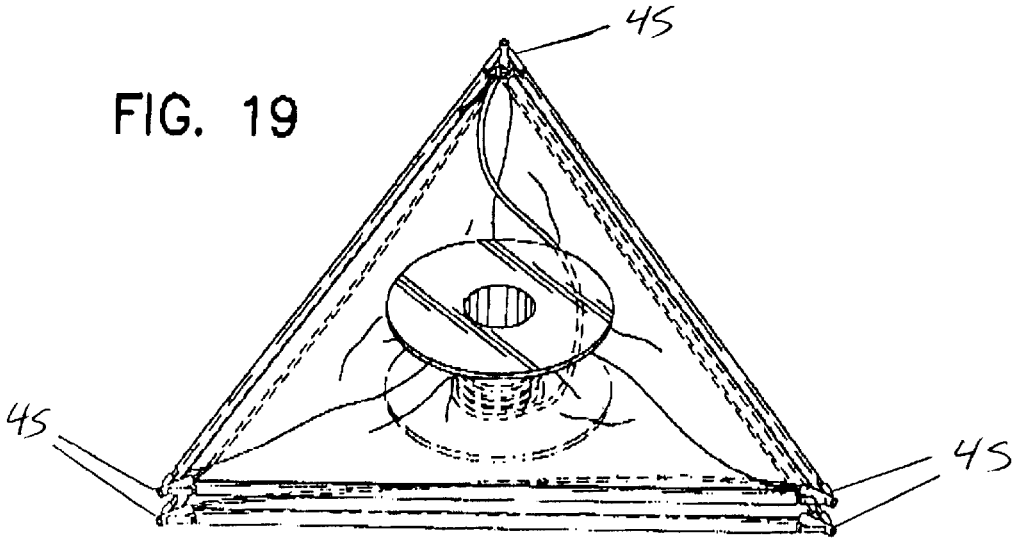
FIG. 19 is a top perspective view of my invention having three corner openings in the storage configuration detailing the line storage reel sidewalls interacting with the kite spar elements.

This flying configuration is very stable. As with the other configurations, small rotations or perturbations of the forward opening 4 with respect to the rearward opening 9 will not disturb the stable configuration of the in the flying configuration and the kite will quickly return to its flying configuration from normally small perturbations of these kind. But larger rotating the forward opening 4 with respect to the rearward opening 9 as shown by the arrows in FIG. 17 will bend and reconfigure the spars 15, converting the kite into the storage configuration shown in FIGS. 18 and 19. This is done the same as with the cylindrical and four corner kites by grasping the forward opening 4 and twisting it with respect to the rearward opening 9 through a recover point, felt when the resistance to rotation suddenly disappears to permit the kite to collapse. When the openings 4 and 9 are close to each other they can be set side by side in a generally flat orientation as is shown by FIGS. 18 and 19. Sidewalls 6 and 7 of the spool 10 may be used to sandwich the spars 15 and the available kite covering 40 in the same manner as with the other previously described kites.

As with the other kites, kite 3 can be quickly converted to the flying configuration from the storage configuration by grasping and rotating the forward opening support member 4 with respect to the rearward opening support member 9 and rotating past a recovery point.

Most of the kite construction material, the tee 20, fiberglass rods forming support members 31, 32, and pultrudded linear carbon rods to cut into spars 15 and kite covering materials 40 are common kite parts and material available from most kite and kite part supply houses throughout the United States of America, such as Goodwinds Kites Inc located at 3333 WALLINGFORD N. Ave. in Seattle, Wash. 98103.

It is clear that the shapes of the forward and rearward openings could be of any shape and polygonal figure, according to the desire and convenience desired by the kite enthusiast and still be within the scope of my invention as long as the openings and kite covering formed are consistent to the manner described above, with spar members 15 spanning under tension between congruent openings.

While the above description contains many specifications, they should not be construed as limitations on the scope of the invention, but rather as an exemplification of the preferred embodiments thereof.

I claim:

1. A Self Erecting Collapsible Kite with line comprising:

a forward support shaped into a closed figure;

a rearward support shaped into a closed figure;

a kite surface material having a channel at a forward edge of said material for receiving said forward support forming a forward opening and another channel at a rearward edge of said material for received said rearward support forming the rearward opening;

the material generally spanning the distance from the forward opening to the rearward opening constraining said openings in an aligned and parallel orientation;

more than one flexible tension member joined at one end to the forward opening and at the other end to the rearward opening, said tension member evenly spaced and congruent between said openings, the length of each tension member sized longer than the distance between the openings, said line attached to the forward opening;

said flexible tension members cooperatively urging the openings to extend from each other to the distance allowed by said kite surface material into a flying configuration whenever said tension members are aligned with each other;

unaligning said flexible tension members from the flying configuration by rotating the forward opening with respect to the rearward opening beyond a force of self-return, the flexible tension members no longer cooperatively urging the forward opening from the rearward opening allowing said openings to be placed adjacent to each other in a generally flat configuration for storage;

realigning said flexible tension members to the flying configuration by re-rotating the forward opening with respect to the rearward opening beyond a force of self-return, the flexible tension members cooperatively urging the forward opening from the rearward opening.

2. The Self Erecting Collapsible Kite of claim 1, said forward and rearward support is each made from a single member.

3. The Self Erecting Collapsible Kite of claim 2 wherein said single member is a flexible tension member formed into a circle.

4. The Self Erecting Collapsible Kite of claim 1 wherein a tee having a first void through opposing arms receives an opening member and a second void within a perpendicular arm of the tee receives the end of tension member, the tee joining said tension member to the opening.

5. The Self Erecting Collapsible Kite of claim 1 wherein each forward and rearward supports are assembled with more than two segment members, into a polygon.

6. The Self Erecting Collapsible Kite of claim 5 wherein said segment members are assembled using resilient joiners, each joiner having adjacent arms with voids sized to receive said segment members and a perpendicular oriented arm with respect to a plane defined by said adjacent arms having a void sized to receive said end of the flexible tension member.

7. The Self Erecting Collapsible Kite of claim 1 further comprising a line storage reel attached to an other end of said line, the line storage reel having side walls sized to interact with said flexible tension members in the storage configuration.

8. The Self Erecting Collapsible Kite of claim 1 further comprising a line storage reel attached to the other end of said line, the line storage reel having one side sized to interact with said flexible tension members in the storage configuration and an other side sized to the approximate configuration of the opening to protect said kite in the storage configuration.

9. The Self Erecting Collapsible Kite of claim 5 where the polygon is triangular.

10. The Self Erecting Collapsible Kite of claim 5 where the polygon is quadrangular.

11. The Self Erecting Collapsible Kite of claim 5 where the polygon is pentagonal.

12. A method of making a Self Erecting Collapsible Kite with line comprising the steps of:

forming a closed forward support;

forming a closed rearward support;

arranging said forward and rearward supports into a spaced parallel orientation;

stitching a forward channel into a forward edge of a kite surface material adaptable for receiving said forward support forming a forward opening of the kite;

stitching a rearward channel into a rearward edge of the kite surface material adaptable for receiving said rearward support forming a rearward opening of the kite;

spanning the surface material between the forward opening and the rearward opening and then stitching said material to constrain the forward and rearward openings into the spaced parallel orientation;

tieing an end of the line to the forward opening;

sizing a plurality of flexible tension members to a length longer than the distance between the openings then;

joining said tension members to the openings to span between said openings in an aligned, evenly spaced, congruent manner, the tension members providing a cooperative urging of the kite into a flying configuration;

collapsing said kite by rotating the forward opening with respect to the rearward opening beyond a force of self-return thereby removing the cooperative urging of the tension members to allow said openings to be placed adjacent to each other in a generally flat configuration for storage;

returning said kite to a flying configuration by re-rotating the forward opening with respect to the rearward opening beyond a force of self-return, the tension members returning thereby to cooperatively urge the kite into a flying configuration.

13. The method of making a Self Erecting Collapsible Kite with line as described in claim 12 where a single member is used to form the closed forward support and another single member is used to form the rearward support.

14. The method of making a Self Erecting Collapsible Kite with line as described in claim 12 where the single member is a resilient tension member to urge each opening into a generally circular configuration.

15. The method of making a Self Erecting Collapsible Kite with line as described in claim 12 where more than two support members are joined to form the forward and rearward support members into polygons.

16. The method of making a Self Erecting Collapsible Kite with line as described in claim 15, the said step of joining the support members at their ends employs joiners having voids on adjacent arms sized to receive said members and placing said tension member into a void on an arm perpendicularly oriented with respect to the plane described by the adjacent arms, on each joiner.

17. The method of making a Self-Erecting Collapsible Kite with line as described in claim 15 where the polygons are triangular.

18. The method of making a Self-Erecting Collapsible Kite with line as described in claim 15 where the polygons are quadrangular.

19. The method of making a Self-Erecting Collapsible Kite with line as described in claim 15 where the polygons are hexagonal.

* * * * *